US006386908B2

(12) United States Patent
Kato et al.

(10) Patent No.: US 6,386,908 B2
(45) **Date of Patent: *May 14, 2002**

(54) ELECTRONIC DEVICE

(75) Inventors: Masahiro Kato, Kanagawa; Tsutomu Asawa, Nagano, both of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/153,926

(22) Filed: Sep. 16, 1998

(30) Foreign Application Priority Data

Sep. 19, 1997 (JP) ..... 9-255501

(51) Int. Cl.[7] ..... H01R 13/60
(52) U.S. Cl. ..... 439/528; 439/501; 439/357
(58) Field of Search ..... 439/528, 501, 439/357

(56) References Cited

U.S. PATENT DOCUMENTS

| | | | | | |
|---|---|---|---|---|---|
| 4,653,833 | A | * | 3/1987 | Czubernat et al. | 339/119 |
| 5,108,059 | A | * | 4/1992 | Curtis | 248/146 |
| 5,318,457 | A | * | 6/1994 | Harting et al. | 439/352 |
| 5,608,607 | A | * | 3/1997 | Dittmer | 361/686 |
| 5,691,882 | A | * | 11/1997 | Ma | 361/684 |
| 5,708,706 | A | * | 1/1998 | Hughes et al. | 379/446 |
| 6,058,089 | A | * | 5/2000 | Youens et al. | 369/75.1 |

FOREIGN PATENT DOCUMENTS

JP 9218931 * 9/1997

* cited by examiner

*Primary Examiner*—Tho D. Ta
*Assistant Examiner*—Truc Nguyen
(74) *Attorney, Agent, or Firm*—Frommer Lawrence & Haug, LLP.; William S. Frommer; Matthew K. Ryan

(57) ABSTRACT

An electronic device including a body and a connecting line. The connecting line is provided with an electrical connector for electrical connection and extends out from the body. The body has a recess for removably retaining therein the connector of the connecting line by inserting the connector into the recess. The electronic device is easy to carry around.

4 Claims, 7 Drawing Sheets

ELECTRONIC DEVICE

BACKGROUND OF THE INVENTION

1. Field of the Invention

The present invention relates to an improvement of an electronic device comprising a body and a connecting line, with the connecting line being provided with an electrical connector for electrical connection to another electronic device, such as a computer, and extending out from the body.

2. Description of the Related Art

In recent years, portable electronic devices, such as portable computers and portable information terminals, have been available.

Portable computers, taken as an example of electronic devices, are becoming thinner and smaller. One type of such portable computers comprises a body and a display portion provided with respect to the body.

Since such portable computers are becoming thinner, drives for driving an information recording medium, such as a floppy disk, cannot be built in the portable computers. Therefore, floppy disk drives or the like are formed outside the portable computers in the form of accessories which are connected to an external terminal of the body of the portable computers.

However, when such externally connecting electronic devices, such as floppy disk drives, having a body and a connecting line, are carried around, the connecting line and the connector of the connecting line extend freely out from body. Therefore, such externally connecting electronic devices are not easy to carry around and are troublesome to handle.

SUMMARY OF THE INVENTION

Accordingly, in order to overcome the above-described problems, it is an object of the present invention to provide an electronic device which is easy to carry around.

To this end, according to the present invention, there is provided an electronic device comprising a body and a connecting line, with the connecting line being provided with an electrical connector for electrical connection and extending out from the body. The body has a recess for removably retaining therein the connector of the connecting line by inserting the connector into the recess.

Therefore, according to the present invention, the body 2 has a recess for removably retaining therein the connector of the connecting line by inserting the connector into the recess.

Inserting the connector of the connecting line into the recess in the body, so that the connector does not extend freely from the body, makes the electronic device easier to carry around.

DESCRIPTION OF THE PREFERRED EMBODIMENTS

A description will now be given of preferred embodiments of the present invention with reference to the attached drawings.

Since the embodiments to be described below are preferred embodiments of the present invention, various specific technological forms are described below. However, unless otherwise specified, these technological forms in no way limit the scope of the present invention.

Figure 1:
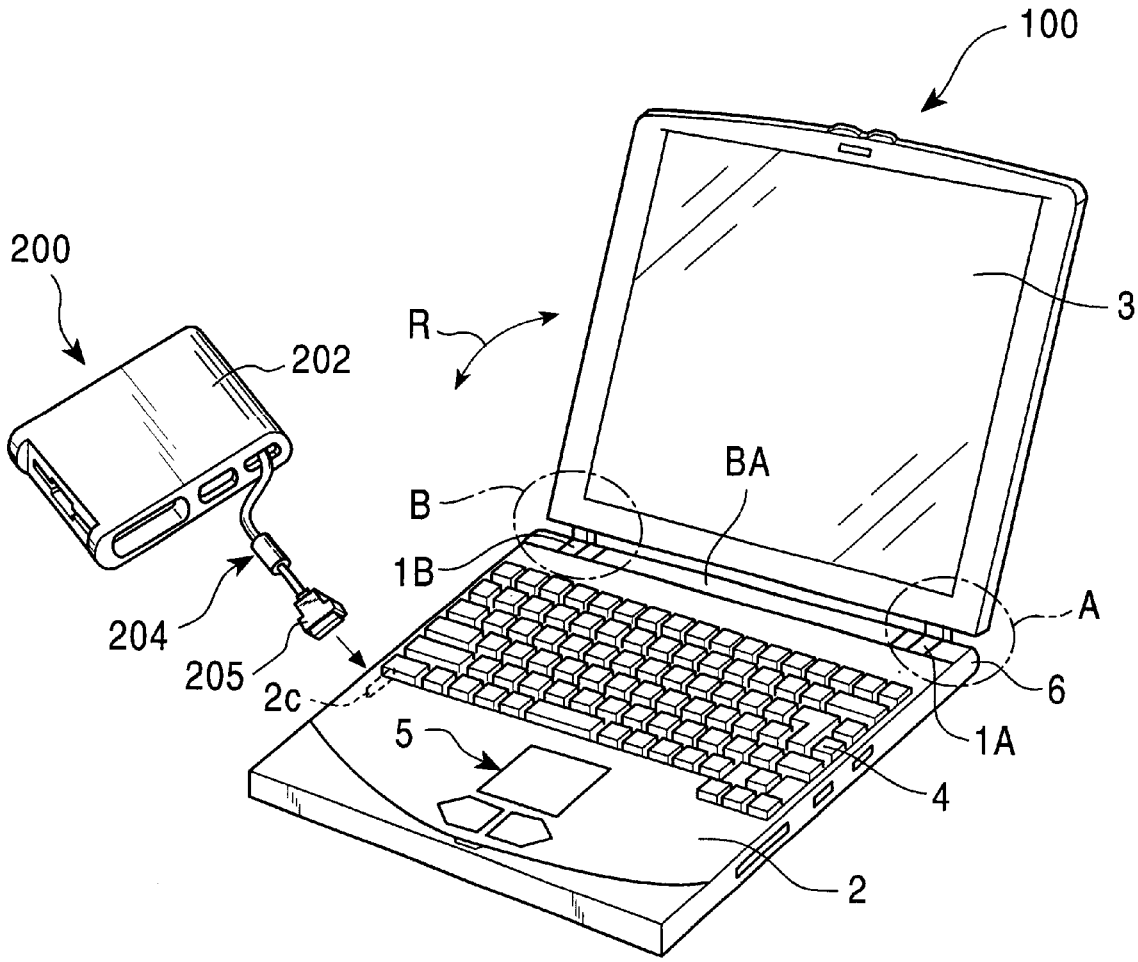
FIG. 1 is a perspective view of a portable computer provided with an externally connecting electronic device in accordance with the present invention.

FIG. 1 shows an example of an electronic device with hinges, which is provided with an externally connecting electronic device in an embodiment of the present invention. In FIG. 1, the portable computer 100 serves as the electronic device with hinges. The portable computer 100 comprises, for example, a body 2, a display portion 3, a keyboard 4, hinges 1A and 1B surrounded by areas A and B, respectively, and a battery pack BA.

The body 2 has the aforementioned keyboard 4, a pointing device 5, etc. A liquid crystal display (LCD) may be used for the display portion 3. Using the hinges 1A and 1B, the display portion 3 is mounted to the body 2 so that it can be opened and closed in the direction of double-headed arrow R. Although not illustrated in FIG. 1, a mouse, or the like, serving as external pointing device, can be externally secured to the body 2.

Since the body 2 of FIG. 1 is thin and has a very small area, as a result of the computer 100 being made thinner, drives, for driving various recording media, cannot be built therein.

To overcome this problem, an externally connecting electronic device 200 is provided such that its connector 201 can be connected to a connector 2C of the body 2.

Figure 2:
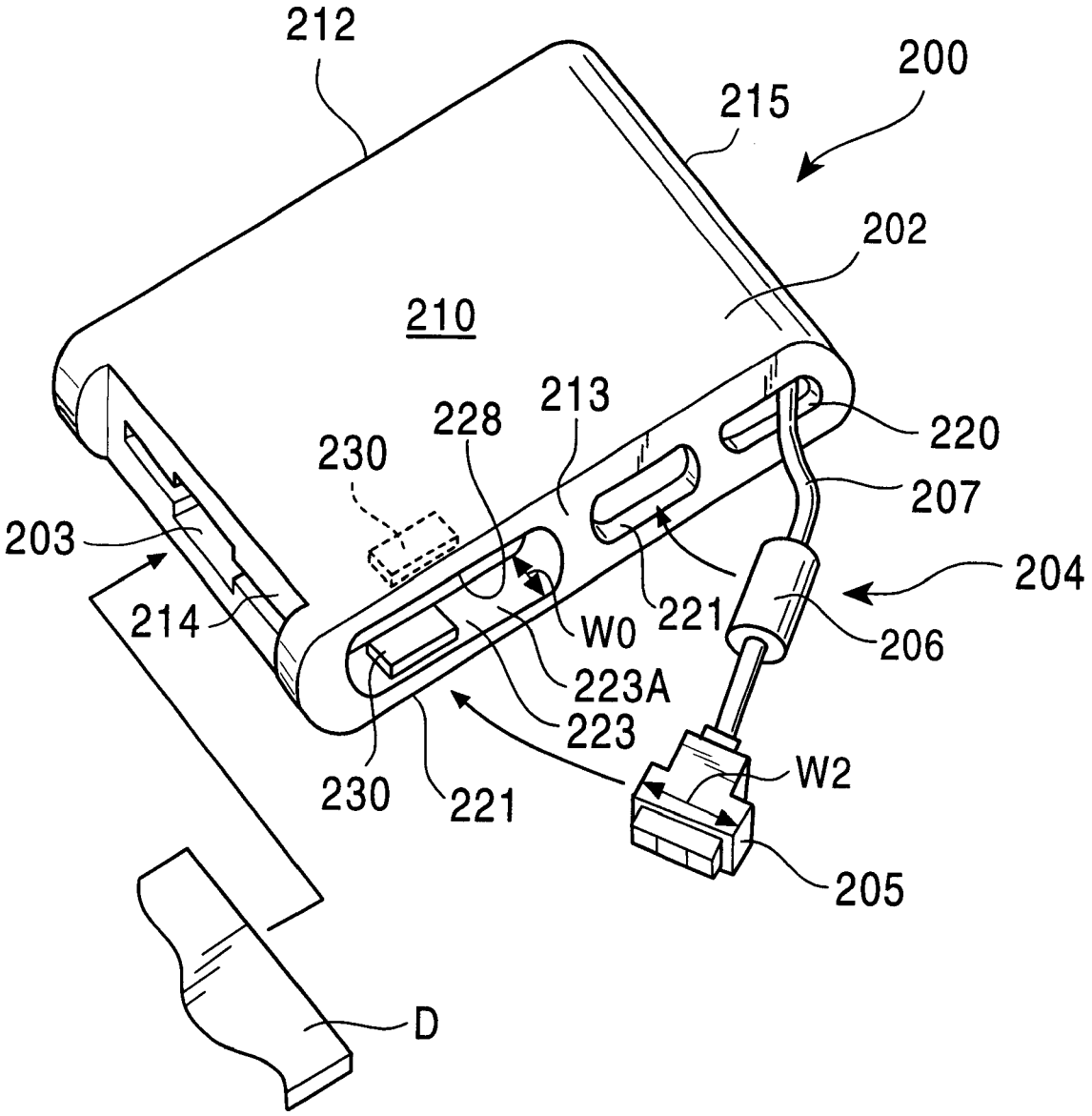
FIG. 2 is a perspective view of the externally connecting electronic of the computer of FIG. 1.
Figure 3:
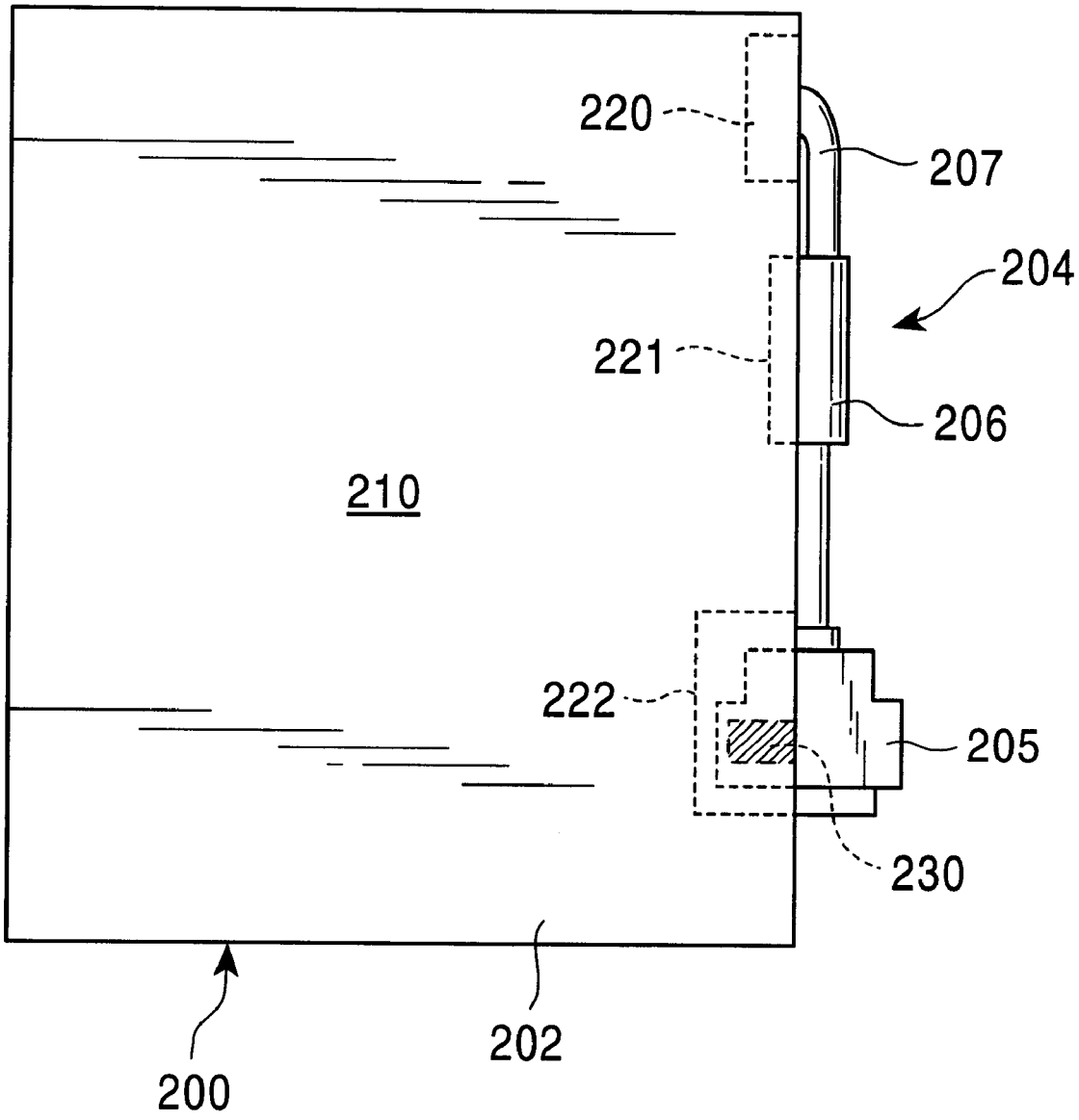
FIG. 3 is a plan view of the externally connecting electronic device of FIG. 2.

The externally connecting electronic device 200 has the structure shown in FIGS. 2 and 3. The externally connecting electronic device 200 drives, for example, a floppy disk (or a disk-shaped information recording medium) D. The electronic device 200 allows information to be recorded onto the information recording medium D, such as a floppy disk, and information recorded on the information recording medium D to be reproduced. An opening 203, for inserting therein the information recording medium D, is formed in the front side of a body 202 of the electronic device 200.

The electronic device 200 has a body 202 and a connecting line 204. The connecting line 204 is provided with an electrical connector 205 and a noise eliminating section 206. The base 207 of the connecting line 204 is connected to a predetermined circuit board side in the body 202.

The body 202 is made of, for example, plastic or metal, and has a top face 210, a bottom face 211, side faces 212 and 213, a front face 214, and a back face 215. Three recesses 220, 221, and 223 are formed in the side face 213. The recess 220 is provided for accommodating therein the peripheral portion of the base 207 of the connecting line 204. The recess 221 is provided for resiliently and removably accommodating the noise eliminating section 206.

The recess 223 is provided for removably retaining at least part of the connector 205 by fitting it therein.

The recess 223 has disposed therein resilient members 230 for retaining the connector 205 by fitting it therebetween. The resilient members 230 are affixed to inside surfaces 223A and 223B of the recess 223 with, for example, an adhesive. The resilient members 230 are each made of a resilient material with a large coefficient of friction, such as plastic or rubber.

The connecting line 204 is made removably retainable at the side face 213 of the body 202 to make the externally connecting electronic device 200 easier to carry around. When the externally connecting electronic device 200, along with the computer 100 of FIG. 1, is carried around in, for example, a bag, and the connector 205 of the connecting line 204 is allowed to freely extend from the body 202, the electronic device 200 cannot be conveniently carried around. This problem becomes serious when a plurality of external connecting electronic devices are to be carried around.

When, as shown in FIGS. 2 and 3, the base 207, the noise eliminating section 206, and the connector 205 of the connecting line 204 are firmly fitted to and retained in their respective recesses 220, 221, and 223 of the body 202, the body 202 and the connecting line 204 are integrally connected together, thereby allowing anyone to easily carry around the external connecting electronic device 200.

In this case, even when the connector 205 is subjected to vibration, it does not get easily dislodged from the recess 223, since it is fitted and retained between the resilient members 230. When the externally connecting electronic device 200, with this structure, is carried around, the connecting line 204, the connector 205, and the noise eliminating section 206 can be properly handled.

A description will now be given of another embodiment of the externally connecting electronic device in accordance with the present invention with reference to FIGS. 4 and 5. The externally connecting electronic device 300 has a body 302 and a connecting line 304. An opening 303, for inserting therein an information recording medium D, is provided in a front face 314 of the body 302. The body 302 has a top face 310, a bottom face 311, side faces 312 and 313, a front face 314, and a back face 315. A recess 323 is formed in the side face 313. A connector 305 of the connecting line 304 can be removably fitted to the recess 323. Resilient members 330 are affixed in the recess 323 with, for example, an adhesive. The depth W of the recess 323 is smaller than the width W1 of the connector 305.

Figure 5:
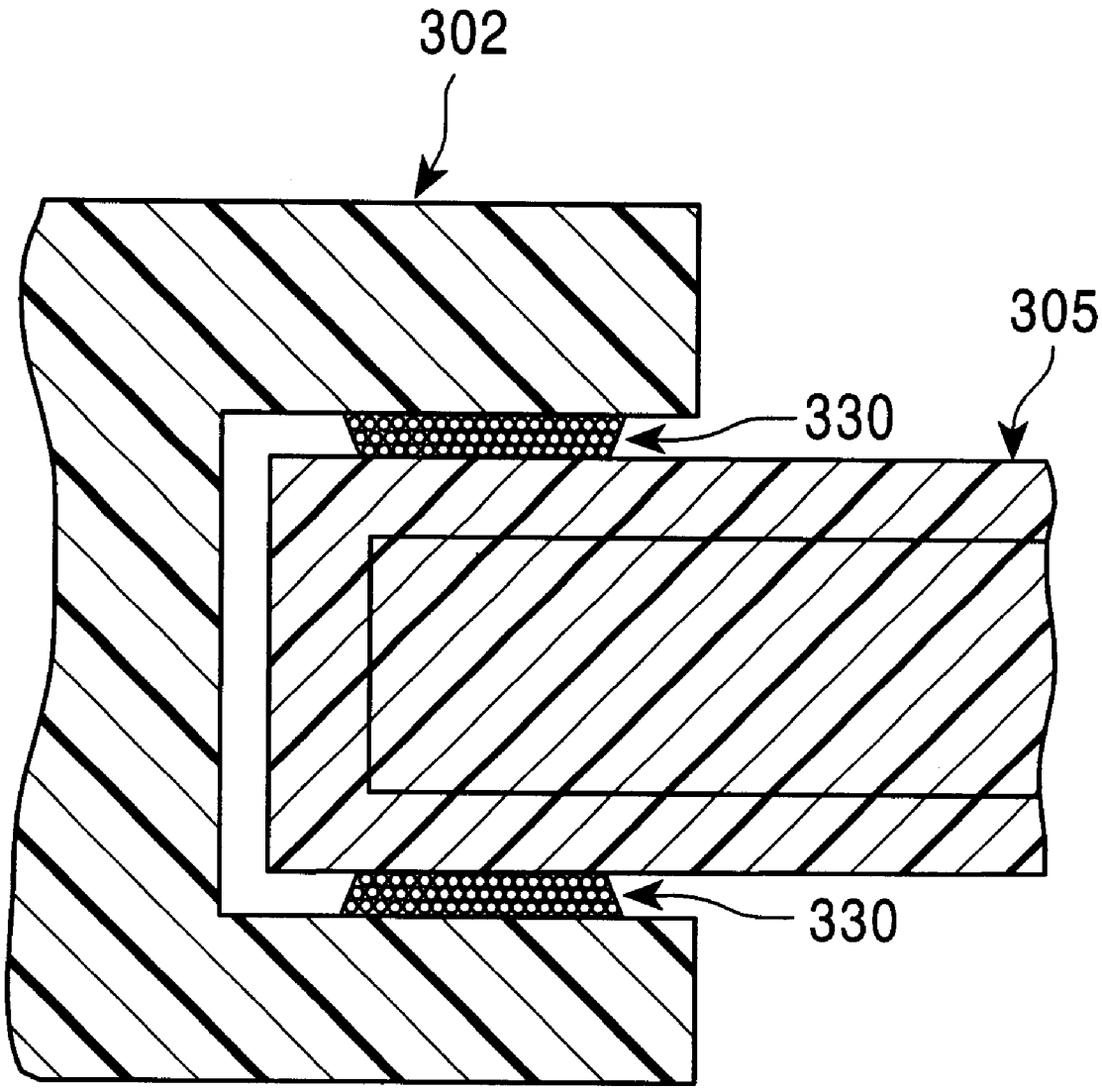
FIG. 5 is a sectional view of part of the externally connecting electronic device of FIG. 4.

The connector 305 of the connecting line 304 can be removably retained between the resilient members 330 by fitting it therebetween, as shown in FIG. 5.

Figure 4:
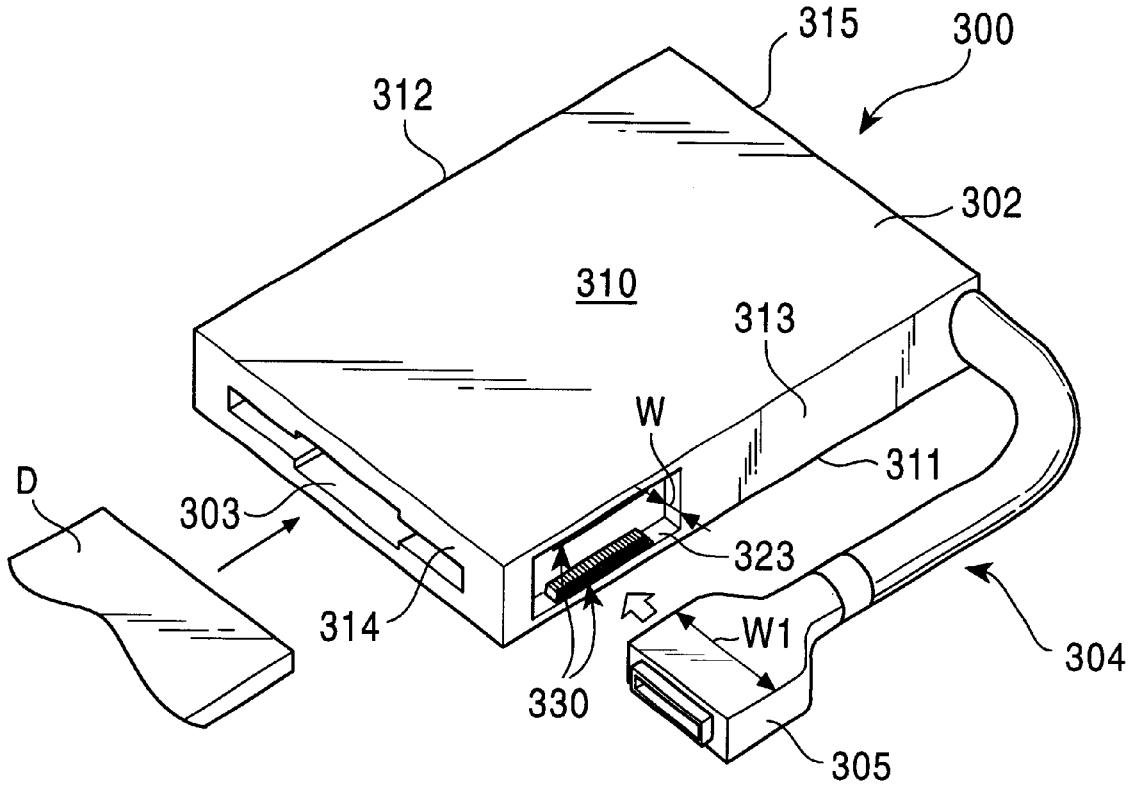
FIG. 4 is a perspective view of another embodiment of the externally connecting electronic device in accordance with the present invention.

In the electronic devices 200 and 300 of FIGS. 2 to 5, the depth W0 of the recess 223 and the depth W of the recess 323 of FIG. 4 are smaller than the width W2 of the connector 205 and the width W1 of the connector 305, respectively. This allows part of the connectors 205 and 305 to be fitted into and retained in the recesses 223 and 323, respectively.

The depths of the recesses 223 and 323 and the widths of the connectors 205 and 305 may be set to allow the connectors 205 and 305 to be completely fitted and retained in their corresponding recesses.

Figure 6:
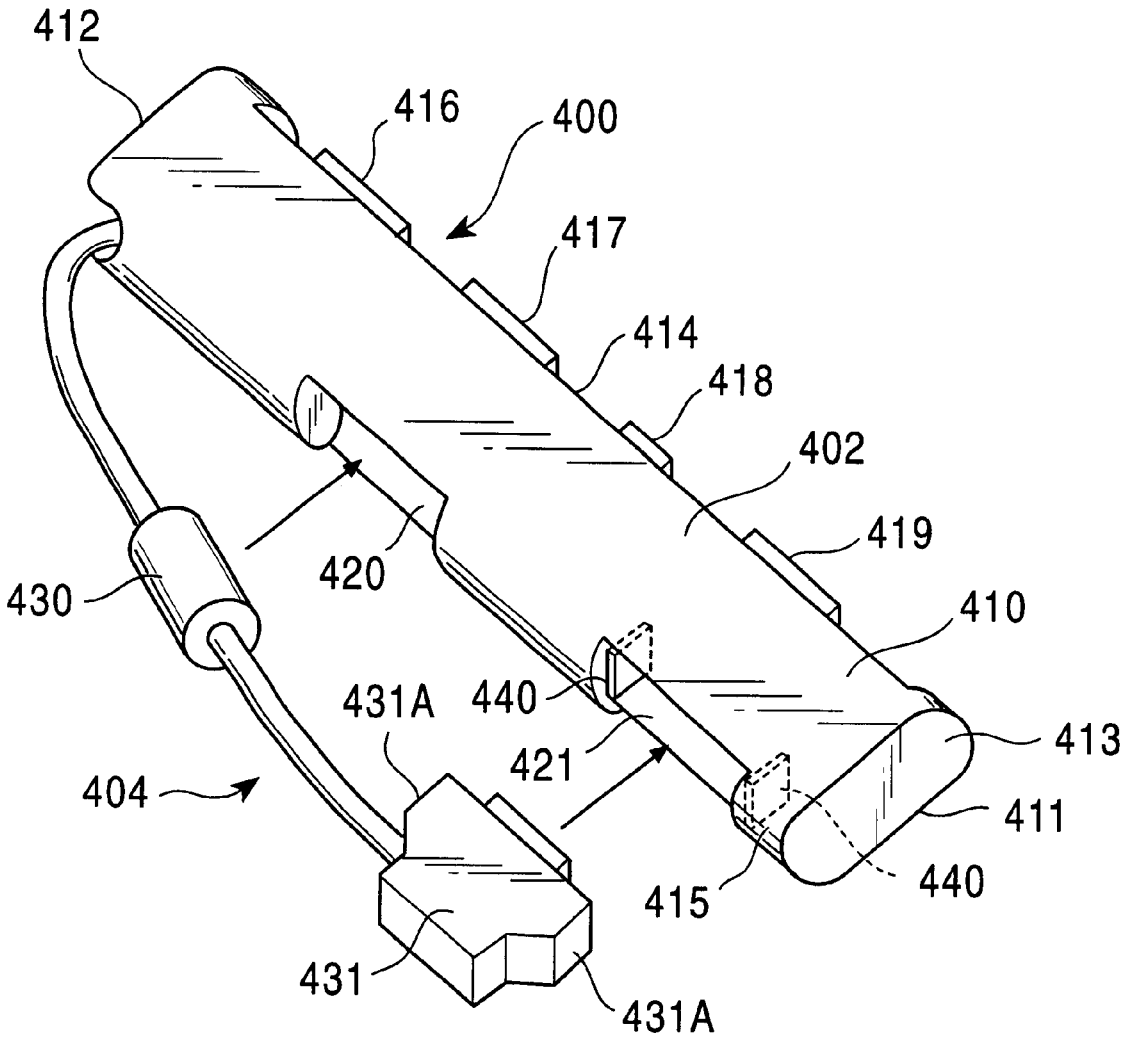
FIG. 6 is a perspective view of still another embodiment of the externally connecting electronic device in accordance with the present invention.
Figure 7:
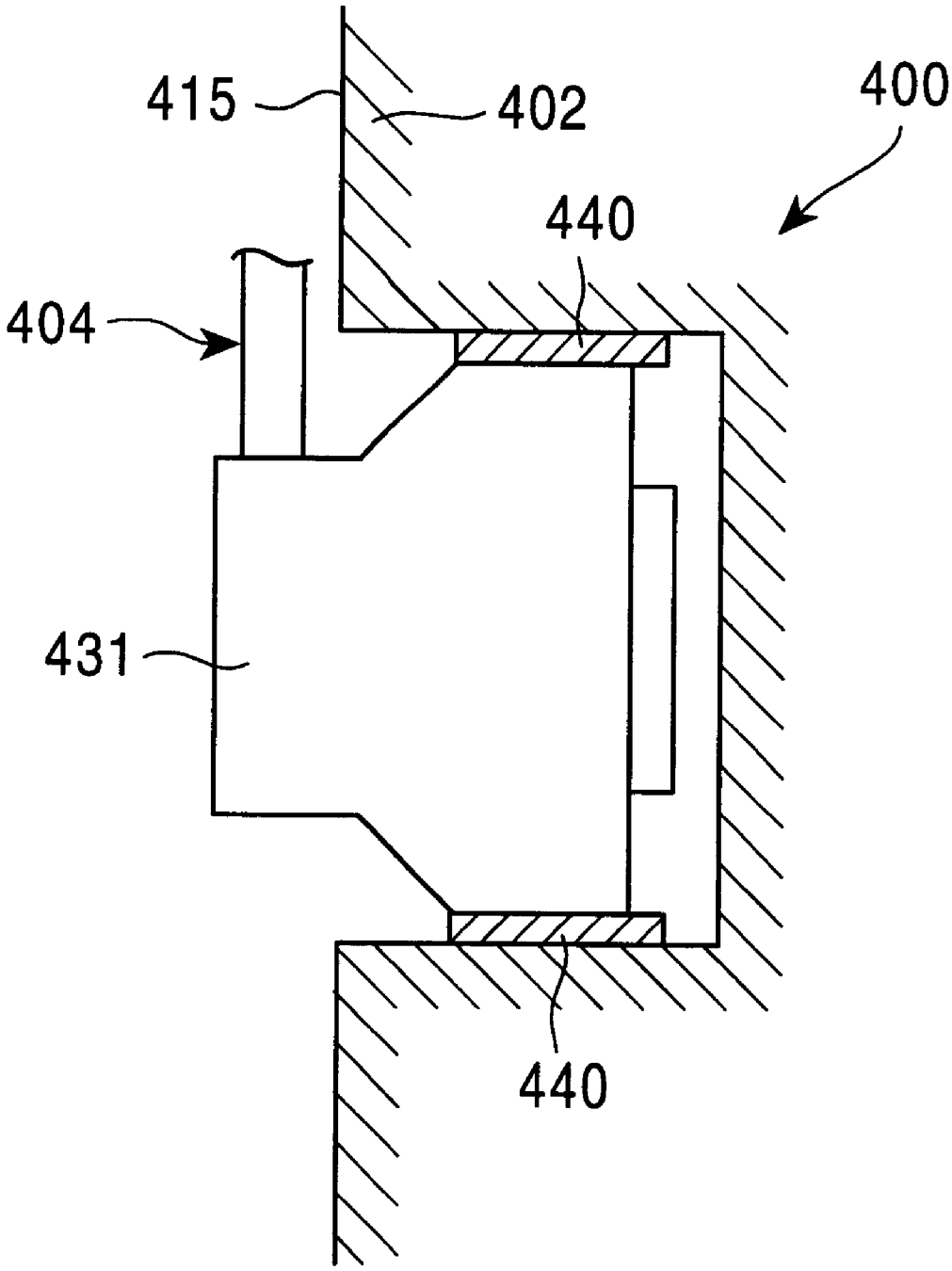
FIG. 7 is a sectional view of part of the externally connecting electronic device of FIG. 6.

A description will now be given of still another embodiment of the externally connecting electronic device in accordance with the present invention with reference to FIGS. 6 and 7. The external connecting electronic device 400 of FIGS. 6 and 7 is a port expansion device with a plurality of ports (or connecting terminals). The electronic device 400 has a body 402 and a connecting line 404. The body 402 has a top face 410, a bottom face 411, side faces 412 and 413, a front face 414, and a back face 415. A plurality of connectors 416, 417, 418, and 419, called ports, are formed at the front face 414. Recesses 420 and 421 are formed in the back face. The recess 420 is provided for securing thereat part of the noise eliminating section 430 of the connecting line 404 by resiliently fitting it therein. The recess 421 is provided for retaining thereat part of the connector 431 of the connecting line 404 by resiliently fitting it therein. In order to resiliently retain the connector 431, resilient members 440 are affixed to the inside of the recess 421, using, for example, an adhesive. The resilient members 440 resiliently retain the connector 431 by retaining sides 431A of the connector 431. The resilient members 440 may each be made of, for example, resiliently deformable plastic or rubber.

FIG. 7 shows the connector 431 being retained by the resilient members 440.

When the connector 431 and the noise eliminating section 430 are fitted into and retained in their respective recesses 421 and 420, with the connector 431 being retained between the resilient members 440, the body 402 and the connecting line 404 are integrally connected together, thereby allowing the electronic device 400 to be conveniently carried around.

It is to be noted that the present invention is not limited to the above-described embodiments.

Although in the above-described embodiments a drive, for driving an information recording medium, and a port expansion device were used as externally connecting electronic devices, other types of externally connecting electronic devices may also be used. They include other types of drives for driving an information recording medium, an externally connecting converter, a display, a speaker, an antenna, an external keyboard, and an information terminal.

As can be understood from the foregoing description, according to the present invention, the electronic device is easy to carry around.

What is claimed is:

1. An electronic device, comprising:

a body having a plurality of side faces; and a connecting line including a base connected to a circuit board in the body and extending outwardly therefrom an electrical connector for electrical connection; and an electronic noise eliminating section, wherein said body has at least three non-contiguous of recesses all formed along the same side face for removably and separably accomodating and retaining therein respectively said base, said electrical connector and said noise eliminating section of said connecting line by fitting said base, said electrical connector and said noise eliminating section of said connecting line into a respective one of said at least three recesses; and a resilient member formed of a material having a large coefficient of friction and disposed in one of said plurality of recesses for resiliently retaining said electrical connector.

2. An electronic device according to claim 1, wherein at least part of said connector is inserted into said respective recess.

3. An electronic device according to claim 1, wherein said body is a drive for recording information onto an information recording medium and reproducing information recorded on the information recording medium.

4. An electronic device according to claim 1, wherein said body is an expansion device with a plurality of electrically connecting terminals.

* * * * *